US007280788B2

(12) United States Patent
Iwakura et al.

(10) Patent No.: US 7,280,788 B2
(45) Date of Patent: Oct. 9, 2007

(54) IMAGE FORMING APPARATUS AND TRANSFERRING METHOD

(75) Inventors: Yoshie Iwakura, Higashiosaka (JP); Kuniaki Nakano, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/232,051

(22) Filed: Sep. 21, 2005

(65) Prior Publication Data

US 2006/0067720 A1 Mar. 30, 2006

(30) Foreign Application Priority Data

Sep. 30, 2004 (JP) ..... 2004-288207

(51) Int. Cl.
*G03G 15/16* (2006.01)
*G03G 15/02* (2006.01)

(52) U.S. Cl. ..... 399/296; 399/50; 399/66

(58) Field of Classification Search ..... 399/66, 399/296, 50

See application file for complete search history.

(56) References Cited

U.S. PATENT DOCUMENTS 4,187,774 A * 2/1980 Iwasa et al. ..... 101/494
5,512,986 A * 4/1996 Toyomura et al. ..... 399/60
5,999,783 A * 12/1999 Folkins ..... 399/296
6,097,919 A * 8/2000 Takeuchi et al. ..... 399/298
6,253,041 B1 * 6/2001 Tomizawa et al. ..... 399/66
6,922,542 B2 * 7/2005 Mizuno et al. ..... 399/302
2006/0051138 A1 * 3/2006 Sato et al. ..... 399/296

FOREIGN PATENT DOCUMENTS

JP 08-063003 3/1996
JP 08-292661 11/1996
JP 10-274892 10/1998

OTHER PUBLICATIONS

Oki Electric Industry Co., Oki Technical Review, 1998.*

* cited by examiner

*Primary Examiner*—David M. Gray
*Assistant Examiner*—Joseph S. Wong
(74) *Attorney, Agent, or Firm*—Renner, Otto, Boisselle & Sklar, LLP

(57) ABSTRACT

An image forming apparatus according to the present invention is provided with a plurality of image bearing members, an intermediate transfer member, a plurality of first transfer devices, a second transfer device, and a charge amount adjustment section. The image bearing members carry images of respective colors. The intermediate transfer member is rotatably disposed at a position opposed to the image bearing members. The first transfer devices form a full-color toner image on the intermediate transfer member by transferring color toner images formed on the image bearing members to the intermediate transfer member. The second transfer device transfers the full-color toner image formed on the intermediate transfer member to a recording sheet. The charge amount adjustment section adjusts the charge amount of toner particles constituting the full-color toner image so as to reduce non-uniformity in a charge amount of toner particles of the full-color toner image on the intermediate transfer member per unit area.

2 Claims, 8 Drawing Sheets

FIG.8

| CHARGE AMOUNT DIFFERENCE | 0 | 0.005 $\mu$ c/cm$^2$ | 0.020 $\mu$ c/cm$^2$ | 0.025 $\mu$ c/cm$^2$ | 0.030 $\mu$ c/cm$^2$ |
|---|---|---|---|---|---|
| EASINESS OF SETTING SECONDARY TRANSFER CURRENT | ○ | ○ | ○ | △ | × |

○:SATISFACTORY
△:NOT SATISFACTORY
×:NOT GOOD

IMAGE FORMING APPARATUS AND TRANSFERRING METHOD

CROSS REFERENCE

This Nonprovisional application claims priority under 35 U.S.C. § 119(a) on Patent Application No. 2004-288207 in Japan on Sep. 30, 2004, the entire contents of which are hereby incorporated by reference.

BACKGROUND OF THE INVENTION

The present invention relates to an electrophotographic image forming apparatus for forming a color image in an intermediate transfer system, and a transferring method applied to that image forming apparatus.

One method for forming a color image in electrophotographic image forming apparatuses is an intermediate transfer system. The intermediate transfer system is a system in which a yellow toner image, a magenta toner image, a cyan toner image, and a black toner image are transferred to an intermediate transfer member (first transfer), and then these toner images attached to the surface of the intermediate transfer member are transferred all at once to a recording sheet (second transfer).

However, in an intermediate transfer system it is difficult to set the electric field strength during the second transfer. This is because an appropriate range of the electric field strength in the second transfer varies in accordance with the charge amount of toner particles attached to the intermediate transfer member per unit area. In addition, the charge amount of toner particles per unit area is affected by the thickness of a toner image formed on the intermediate transfer member, and thus the appropriate range of the electric field strength in the second transfer is sometimes different from position to position even within the same toner image.

When performing the second transfer outside the appropriate range of the transfer electric field strength, toner particles to be transferred to a recording sheet in the second transfer are more likely to remain on the side of the intermediate transfer member. When toner remains on the intermediate transfer member, a desired density cannot be attained in a monochrome image. Further, in the case of a color image, the ratio at which color toner images are mixed changes, and thus the color balance of a reproduced full-color toner image is degraded.

In order to address this problem, JP H08-292661A has disclosed a configuration in which a photoreceptor drum is used as a second transfer device, so as to satisfactorily perform second transfer when forming a color image in the intermediate transfer system. In this configuration, a latent image potential based on the image data is formed on the circumferential face of the photoreceptor drum as the second transfer device when toner images are transferred all at once from the intermediate transfer member to paper. It is described that the configuration enables a plurality of kinds of electric fields in the second transfer each having an appropriate strength to be set for the portions of the toner image, and thus it is possible to satisfactorily perform the second transfer regardless of the non-uniformity in the charge amount of toner particles attached to the intermediate transfer member per unit area.

However, the invention relating to JP H08-292661A cannot be applied when the photoreceptor drum is not used as the second transfer device, and thus the types of image forming apparatuses to which the invention can be applied are limited.

It is an object of the present invention to provide an image forming apparatus and a transferring method with which the second transfer strength in the color image forming process in an intermediate transfer system can be set easily with a simple configuration.

SUMMARY OF THE INVENTION

The image forming apparatus according to the present invention is provided with a plurality of image bearing members, an intermediate transfer member, a plurality of first transfer devices, a second transfer device, and a charge amount adjustment section. The image bearing members carry images with colors that are mutually different. The intermediate transfer member is rotatably disposed at a position opposed to the image bearing members. The first transfer devices form a full-color toner image on the intermediate transfer member by transferring color toner images formed on the image bearing members to the intermediate transfer member. The second transfer device transfers the full-color toner image formed on the intermediate transfer member to a recording sheet. The charge amount adjustment section adjusts the charge amount of toner particles constituting the full-color toner image so as to reduce the non-uniformity in the charge amount of the toner particles of the full-color toner image on the intermediate transfer member per unit area.

The color toner images formed on the image bearing members are transferred via the intermediate transfer member to a recording sheet. At that time, a full-color toner image is formed on the intermediate transfer member by placing the color toner images one on the top of another on the intermediate transfer member. In the full-color toner image formed on the intermediate transfer member, the charge amount of toner particles per unit area is large in thick portions, and the charge amount of toner particles per unit area is small in thin portions.

The charge amount adjustment section narrows the range of non-uniformity in the charge amount of toner particles of a full-color toner image per unit area. This is because the charge amount of toner particles constituting a full-color toner image on the intermediate transfer member affects an appropriate range of the electric field strength in the second transfer when the full-color toner image is transferred from the intermediate transfer member to the recording sheet. When the range of the non-uniformity in the charge amount of toner particles of the full-color toner image per unit area is narrowed by the charge amount adjustment section, the range of the electric field strength appropriate for the entire range of the full-color toner image in the second transfer widens . As a result, the second transfer voltage value and the second transfer current value in the image forming process in the intermediate transfer system can be set easily.

As a representative example of the charge amount adjustment section, a charger is conceivable that has the same polarity as the polarity of toner particles constituting a full-color toner image, and that charges the toner particles of the full-color toner image on the intermediate transfer member. Further, the amount of color toner images attached to the image bearing members may be adjusted or the charge amount of toner particles constituting the color toner images may be adjusted by adjusting the stirring speed of developer or the development bias in the developing device.

BRIEF DESCRIPTION OF THE DRAWINGS

FIG. 8 is a diagram showing the relationship between the charge amount difference and the easiness of setting the second transfer current.

DESCRIPTION OF THE PREFERRED EMBODIMENTS

Figure 1:
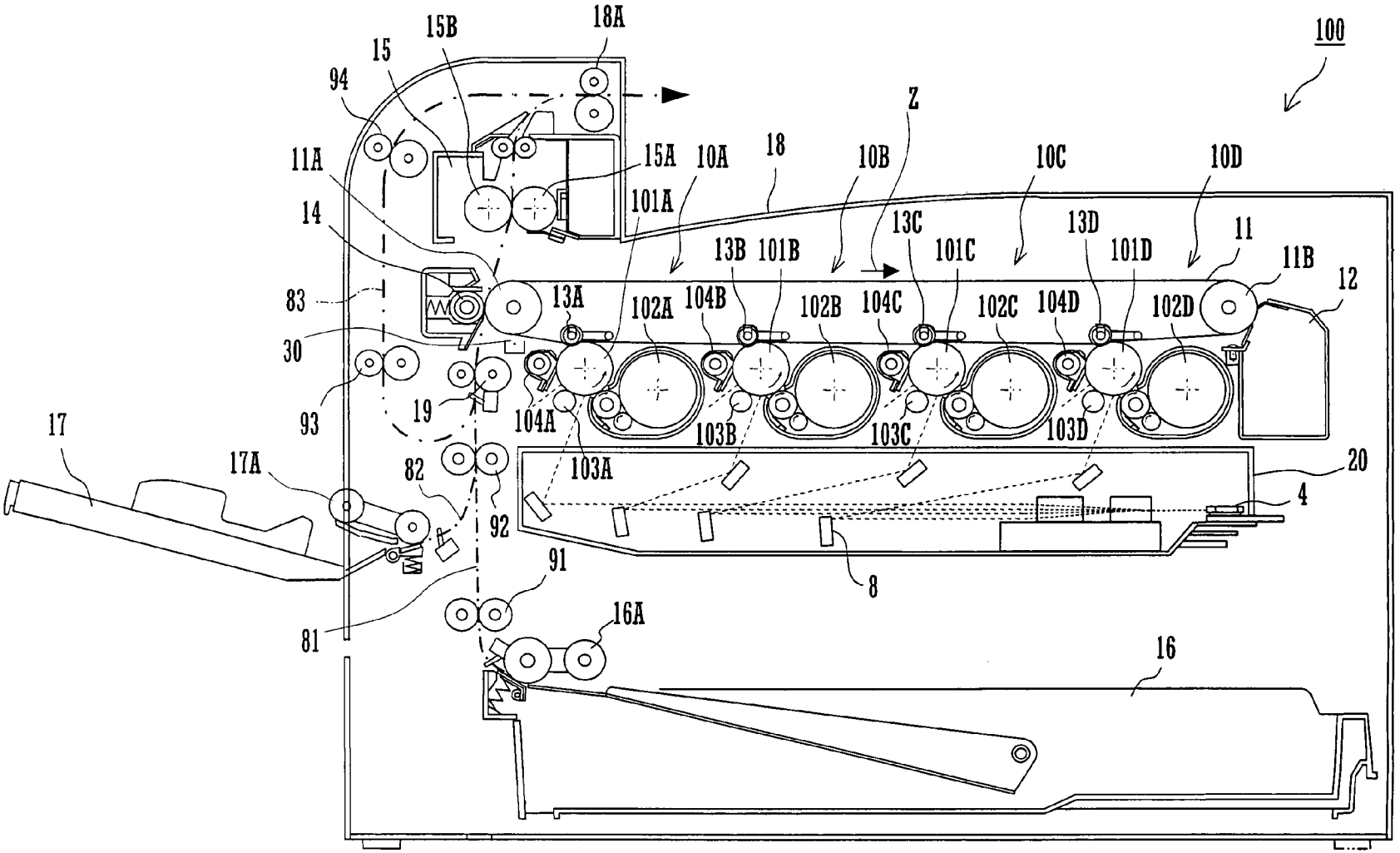
FIG. 1 is a view showing a structural overview of an image forming apparatus of the present invention.

An image forming apparatus 100 shown in FIG. 1 forms a multi-color or single-color image on paper based on input image data. The image forming apparatus 100 is provided with image forming portions 10A to 10D, an exposure unit 20, an intermediate transfer belt 11, first transfer rollers 13A to 13D, a second transfer roller 14, a fixing device 15, paper transport paths 81 to 83, a paper feed cassette 16, a manual paper feed tray 17, and a paper receiving tray 18.

The image forming portions 10A to 10D form images based on image data respectively corresponding to the colors black (K), cyan (C), magenta (M), and yellow (Y). The image forming portions 10A to 10D are arranged along the direction in which the intermediate transfer belt 11 rotates, indicated by the arrow Z. The image forming portion 10A is provided with a photoreceptor drum 101A, a charge roller 103A, a developing unit 102A, a transfer roller 13A, and a cleaning unit 104A. The image forming portion 10B is provided with a photoreceptor drum 101B, a charge roller 103B, a developing unit 102B, a transfer roller 13B, and a cleaning unit 104B. The image forming portion 10C is provided with a photoreceptor drum 10C, a charge roller 103C, a developing unit 102C, a transfer roller 13C, and a cleaning unit 104C. The image forming portion 10D is provided with a photoreceptor drum 101D, a charge roller 103D, a developing unit 102D, a transfer roller 13D, and a cleaning unit 104D. Herein, the image forming portions 10A to 10D have the same basic configuration, and thus mainly the configuration of the image forming portion 10A is described, and an explanation of the image forming portions 10B to 10D is omitted.

The charge roller 103A is a contact charger that charges the circumferential face of the photoreceptor drum 101A uniformly to a predetermined potential. It is also possible to use contact charging devices using charge brushes or non-contact charging devices using chargers, instead of the charge roller 103A.

The exposure unit 20 is provided with a polygon mirror 4, reflection mirrors, and a semiconductor laser (not shown), and emits a plurality of laser beams modulated based on black (K), cyan (C), magenta (M), and yellow (Y) color image data onto the photoreceptor drums 101A to 101D, respectively. Thus, latent electrostatic images with the colors black (K), cyan (C), magenta (M), and yellow (Y) are respectively formed on the photoreceptor drums 101A to 101D.

The developing unit 102A supplies toner particles to the photoreceptor drum 101A on which the latent image is formed to form a toner image on the photoreceptor drum 101A. The developing unit 102A stores black toner particles and forms a black toner image on the photoreceptor drum 101A. Further, the developing units 102B to 102D store cyan, magenta, and yellow toner particles. The cleaning unit 104A removes and recovers toner remaining on the circumferential face of the photoreceptor drum 101A after development and image transfer.

The intermediate transfer belt 11 is disposed above the photoreceptor drums 101A to 101D. The intermediate transfer belt 11 is stretched around a driving roller 11A and a driven roller 11B, and rotates in the direction of the arrow Z. The outer circumferential face of the intermediate transfer belt 11 is opposed to the circumferential faces of the photoreceptor drums 101A to 101D.

The first transfer rollers 13A to 13D are arranged at positions that are opposed to the photoreceptor drums 101A to 101D having the intermediate transfer belt 11 therebetween. The first transfer rollers 13A to 13D have a configuration in which the circumferential face of a shaft made of a metal with a diameter of 8 to 10 mm is coated with a conductive elastic material. In this embodiment, stainless steel is used as the shafts of the first transfer rollers 13A to 13D, and ethylene propylene rubber (EPDM) is used as the elastic material on the circumferential faces. However, it is possible to use urethane foam as the elastic material on the circumferential faces, instead of EPDM.

When a first transfer bias with a polarity opposite to that of the toner is applied to the first transfer rollers 13A to 13D, the toner images carried on the circumferential faces of the photoreceptor drums 101A to 101D are transferred to the intermediate transfer belt 11. In this embodiment, the electric field strength during the first transfer is controlled by a constant voltage control. When color toner images are transferred from the photoreceptor drums 101A to 101D to the intermediate transfer belt 11, a full-color toner image is formed on the outer circumferential face of the intermediate transfer belt 11. It is usually understood that a full-color toner image includes all of a black toner image, a cyan toner image, a magenta toner image, and a yellow toner image, but in the present invention, any toner image is taken as a full-color toner image as long as it includes at least one of a black toner image, a cyan toner image, a magenta toner image, and a yellow toner image. In a case in which a image forming process is performed based only on a subset of the colors black (K), cyan (C), magenta (M), and yellow (Y), a toner image is formed only on a subset of the photoreceptor drums, among the four photoreceptor drums 101A to 101D, corresponding to the colors of input image data. For example, during monochrome image formation, a toner image is formed only on the photoreceptor drum 101A, and only a black toner image is transferred to the outer circumferential face of the intermediate transfer belt 11.

The second transfer roller 14 is pressed at a predetermined nip pressure against the outer circumferential face of the intermediate transfer belt 11. The full-color toner image transferred to the outer circumferential face of the intermediate transfer belt 11 is transported to the position of the second transfer roller 14 by the rotation of the intermediate transfer belt 11. While paper fed from the paper feed cassette 16 or the manual paper feed tray 17 passes a position between the second transfer roller 14 and the intermediate transfer belt 11, a second transfer bias with polarity opposite to that of the toner is applied to the second transfer roller 14.

A charger 30 and a cleaning unit 12 are arranged around the intermediate transfer belt 11. The charger 30 is disposed such that it is opposed to the intermediate transfer belt 11 at a position between the second transfer roller 14 and the first transfer roller 13A. The cleaning unit 12 recovers toner particles remaining on the intermediate transfer belt 11.

The fixing device 15 is provided with a heating roller 15A and a pressing roller 15B, and fixes a toner image transferred to the paper, onto the paper with heat and pressure. The paper receiving tray 18 holds paper discharged from the image forming apparatus 100 by paper discharge rollers 18A.

The paper transport path 81 extends from the paper feed cassette 16, via a position between the second transfer roller 14 and the intermediate transfer belt 11, to the paper discharge rollers 18A. Pick-up rollers 16A for feeding paper in the paper feed cassette 16 onto the paper transport path 81 one by one, transport rollers 91 for transporting the fed paper upward, and registration rollers 19 for guiding the transported paper to a position between the second transfer roller 14 and the intermediate transfer belt 11 at a predetermined timing are arranged along the paper transport path 81.

The paper transport path 82 extends from the manual paper feed tray 17 to a junction with the paper transport path 81. Pick-up rollers 17A are arranged in the most upstream portion of the paper transport path 82. The paper transport path 83 guides the paper that has passed through the fixing device 15 again to the position of the registration rollers 19.

The paper discharge rollers 18A are freely rotatable in both the forward and reverse directions. The paper discharge rollers 18A are driven in the forward direction to discharge paper to the paper receiving tray 18 during simplex image formation in which an image is formed on one side of paper, and during the second side image formation of duplex image formation in which an image is formed on both sides of paper. On the other hand, during the first side image formation of duplex image formation, the paper discharge rollers 18A are driven in the forward direction until the rear edge of the paper passes through the fixing device 15, and are then driven in the reverse direction to guide the paper onto the paper transport path 83 in a state where the rear edge of the paper is held by the paper discharge rollers 18A.

In the image forming apparatus 100, the first transfer rollers 13B to 13D are parted from the intermediate transfer belt 11, and only the first transfer roller 13A is in contact with the intermediate transfer belt 11 during monochrome image formation. On the other hand, all of the first transfer rollers 13A to 13D are in contact with the intermediate transfer belt 11 when monochrome image formation is not being performed.

Figure 2:
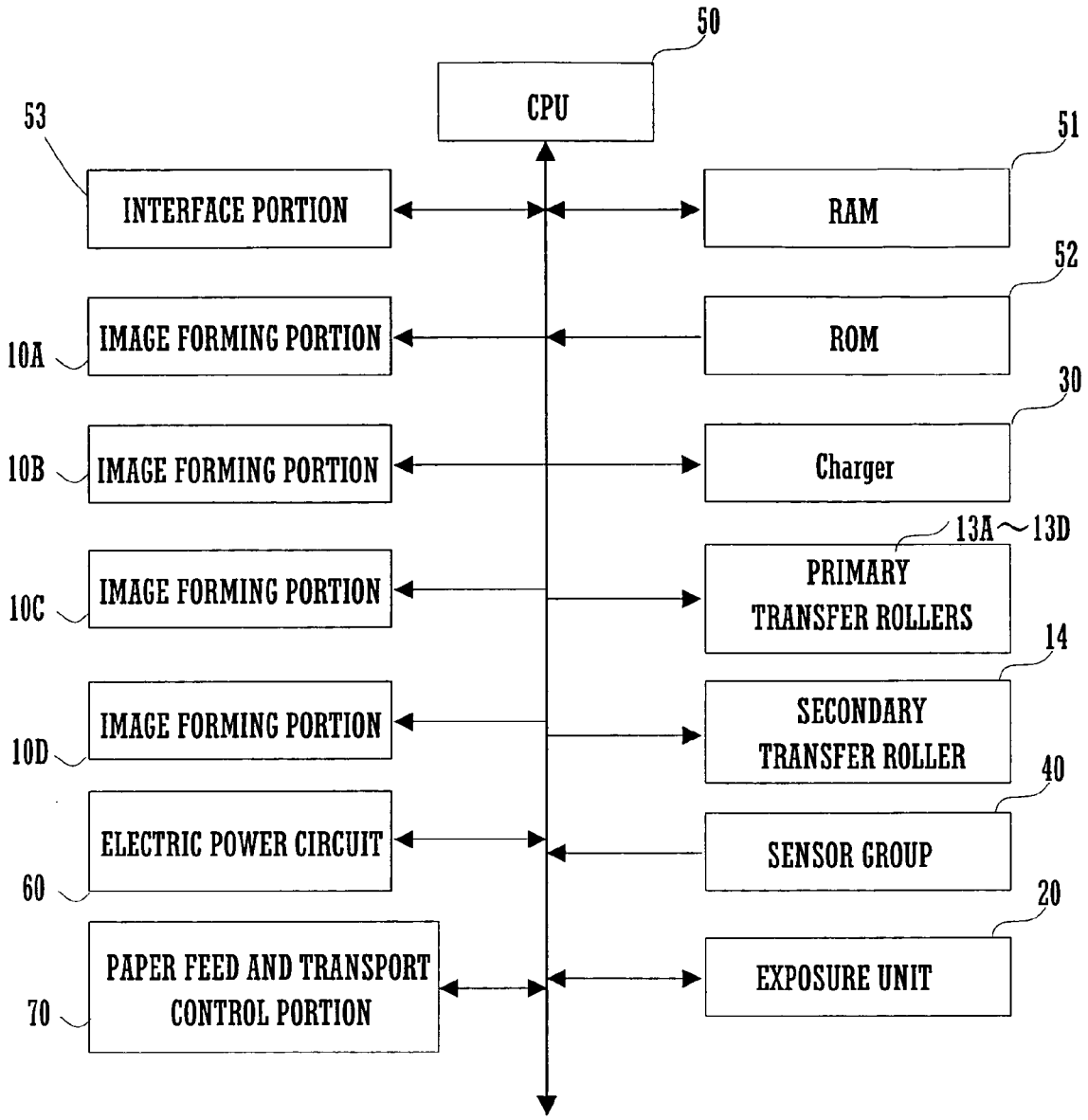
FIG. 2 is a block diagram showing a structural overview of the image forming apparatus of the present invention.

FIG. 2 is a block diagram showing a structural overview of the image forming apparatus 100. The image forming apparatus 100 is provided with a CPU 50. An interface portion 53, the image forming portions 10A to 10D, an electric power circuit 60, a paper feed and transport control portion 70, a RAM 51, a ROM 52, the charger 30, the first transfer rollers 13A to 13D, the second transfer roller 14, a sensor group 40, and the exposure unit 20 are connected to the CPU 50. The interface portion 53 is connected to a network, and receives image data input through the network. The electric power circuit 60 supplies electric power to the portions of the image forming apparatus 100. For example, the electric power circuit 60 supplies set electric power to the first transfer rollers 13A to 13D and the second transfer roller 14, based on a command from the CPU 50. The paper feed and transport control portion 70 controls a paper feed operation and a paper transport operation in the image forming apparatus 100, based on the command from the CPU 50. The RAM 51 is a volatile memory for temporarily storing, for example, image data. The ROM 52 stores a program necessary for the operation of the image forming apparatus 100.

The charger 30 is a scorotron pin array charger with the same polarity as the toner. The charger 30 has a grid for controlling charged particles passing through. The grid is attached to the opening face of the charger 30, and is used for letting the charge potential converge on a predetermined value. In this embodiment, the potential of the grid on the charger 30 is set to approximately −150 V.

The sensor group 40 detects information necessary for controlling the image forming apparatus 100. In this embodiment, the thickness of a full-color toner image on the intermediate transfer belt 11 is detected using the sensor group 40.

Figure 3:
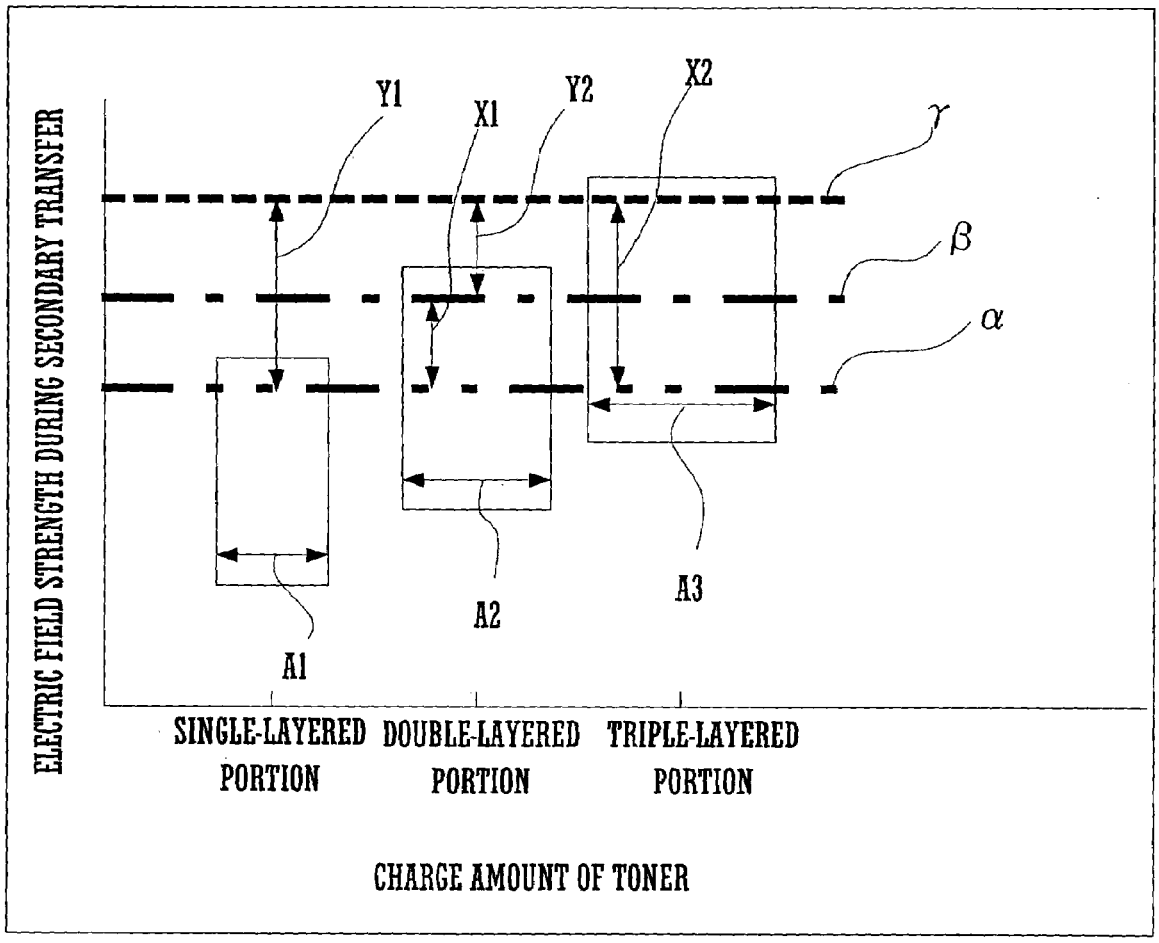
FIG. 3 is a diagram showing the relationship between the charge amounts of toner and appropriate values of the electric field strength during the second transfer.

FIG. 3 is diagram showing the relationship between the charge amounts of toner and appropriate values of the electric field strength during the second transfer. In FIG. 3, the electric field strengths optimal for a single-layered portion, a double-layered portion, and a triple-layered portion in the second transfer are respectively shown by $\alpha$, $\beta$, and $\gamma$. Further, the amounts by which the layer thickness changes in accordance with the change of the gradation between the single-layered portion, the double-layered portion, and the triple-layered portion are respectively shown by A1, A2, and A3, and appropriate ranges of the electric field strengths in the second transfer of the single-layered portion, the double-layered portion, and the triple-layered portion are shown by rectangle forms. Herein, the single-layered portion refers to a portion in which toner particles with a single color in a full-color toner image are layered, the double-layered portion refers to a portion in which toner particles with two colors in a full-color toner image are layered, and the triple-layered portion refers to a portion in which toner particles with three or more colors in a full-color toner image are layered.

A case is considered in which the electric field strength in the second transfer is set to $\alpha$. In this case, the set electric field strength $\alpha$ in the second transfer is smaller than the optimal electric field strength $\beta$ during the second transfer of the double-layered portion by X1, and is smaller than the optimal electric field strength $\gamma$ during the second transfer of the triple-layered portion by X2. As a result, a problem may occur in which a part of a full-color toner image remains on the intermediate transfer belt 11 during the second transfer of the double-layered portion or the triple-layered portion.

On the other hand, a case is considered in which the electric field strength during the second transfer is set to $\gamma$. In this case, the set electric field strength $\gamma$ during the second transfer is larger than the optimal electric field strength $\alpha$ during the second transfer of the single-layered portion by Y1, and is larger than the optimal electric field strength $\beta$ during the second transfer of the double-layered portion by Y2. As a result, a problem may occur in which toner particles scatter during the second transfer of the single-layered portion or the double-layered portion.

These problems occur because the thickness of the full-color toner image on the intermediate transfer belt 11 is not uniform. The charge amount of toner particles in a full-color toner image per unit area usually increases in proportion to the thickness of the full-color toner image at that position. Accordingly, the charge amount of toner particles per unit area becomes non-uniform even within one full-color toner image, and an appropriate value of the electric field strength during the second transfer is different from position to position even within one full-color toner image.

Figure 4:
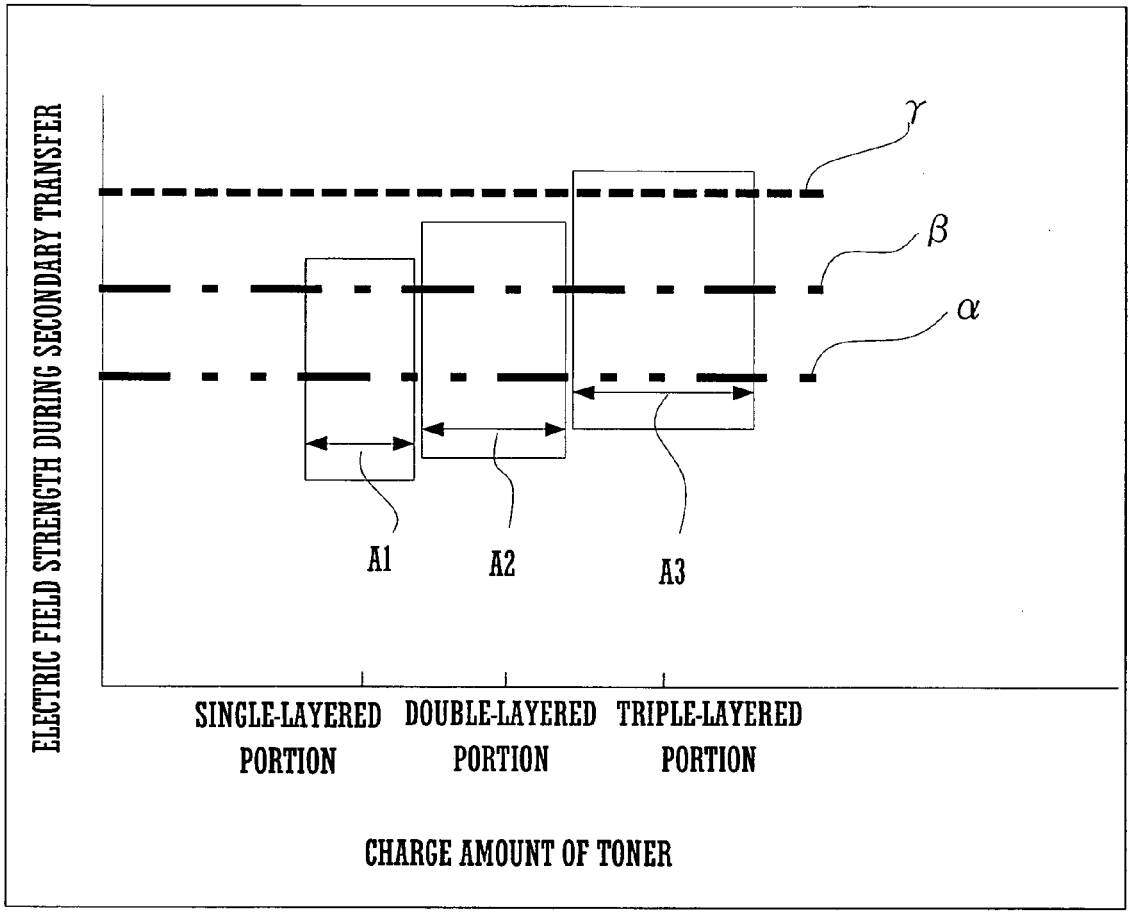
FIG. 4 is a diagram showing the relationship between the charge amounts of toner and appropriate values of the electric field strength in the second transfer.

In this embodiment, toner particles constituting a full-color toner image on the intermediate transfer belt 11 are charged with the charger 30. Thus, the non-uniformity in the charge amount of the toner particles in one full-color toner image per unit area is reduced, so that the range in which the appropriate ranges of the electric field strengths in the second transfer of the single-layered portion, the double-layered portion, and the triple-layered portion are overlapped becomes wider as shown in FIG. 4. As a result, the electric field strength that can be applied as appropriate to all of the single-layered portion, the double-layered portion, and the triple-layered portion in the second transfer can be set easily.

Figure 5:
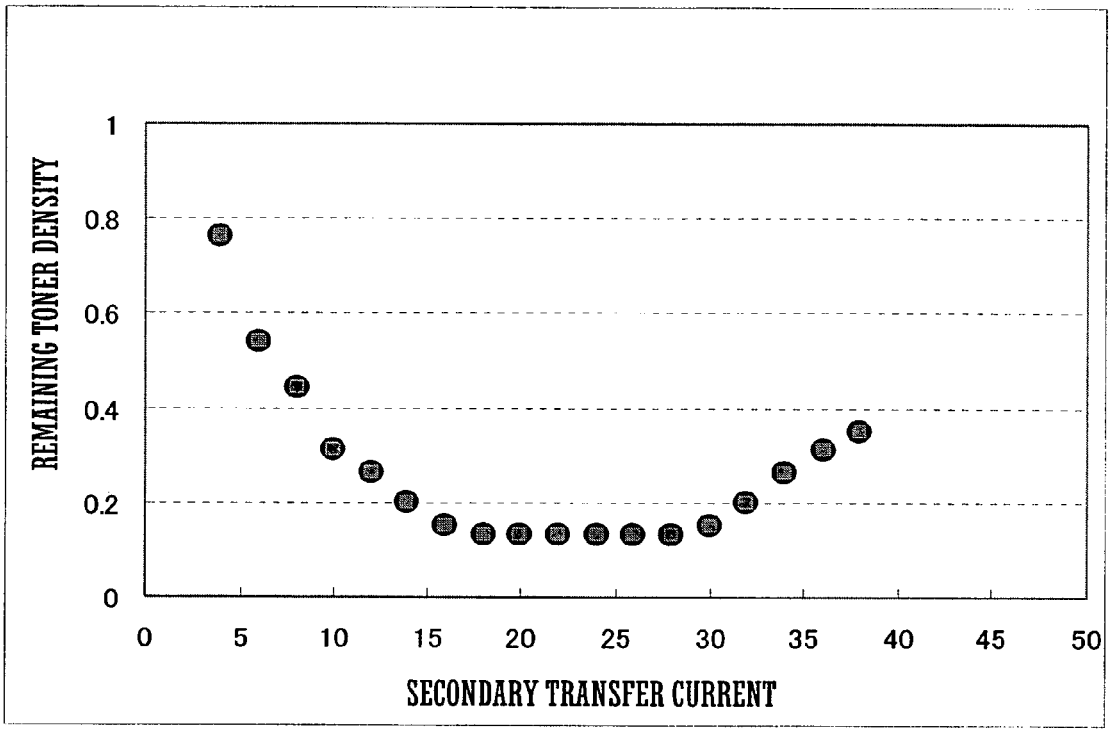
FIG. 5 is a diagram showing the relationship between the second transfer current value and the remaining toner density.

FIG. 5 shows the relationship between the second transfer current and the remaining toner density relating to the single-layered portion when the charger 30 is not used. FIG. shows an example in which the optimal transfer current of the single-layered portion having a charge amount of −0.010 μC/cm$^2$ is 18 μA to 26 μA.

Figure 6:
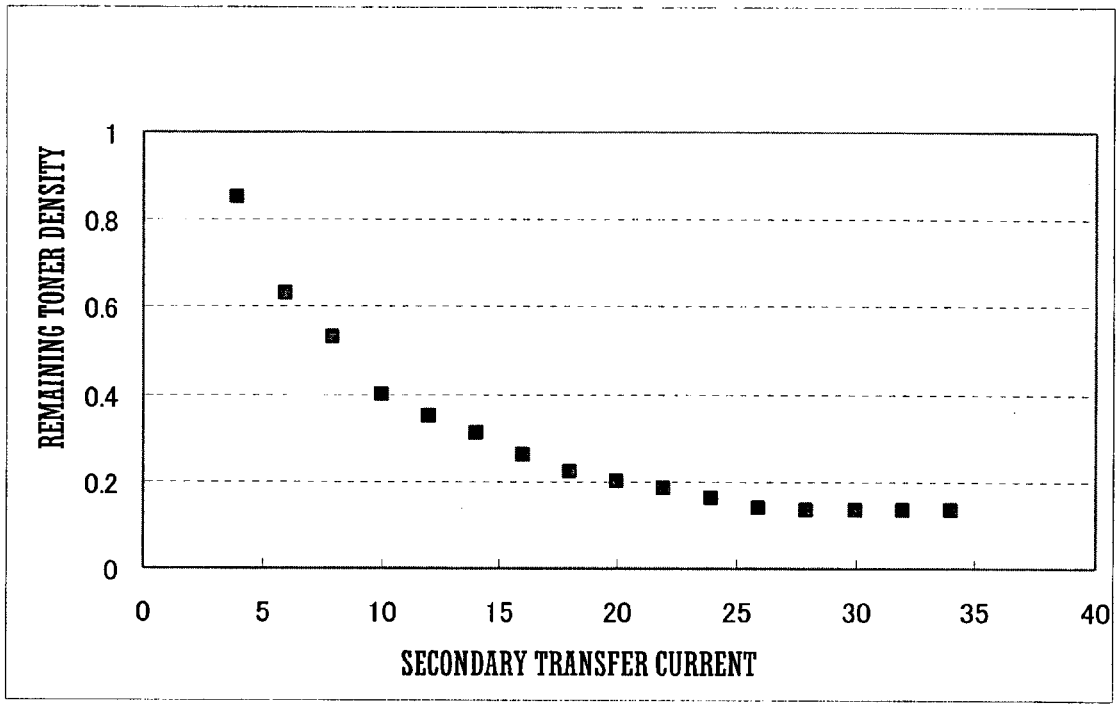
FIG. 6 is a diagram showing the relationship between the second transfer current value and the remaining toner density.

FIG. 6 shows the relationship between the second transfer current and the remaining toner density relating to the triple-layered portion when the charger 30 is not used. FIG. 6 shows an example in which the optimal transfer current of the triple-layered portion having a charge amount of −0.036 μC/cm$^2$ is 28 μA to 35 μA. In the examples shown in FIGS. 5 and 6, the difference between the charge amounts of the single-layered portion and the triple-layered portion is 0.026 μC/cm$^2$, and there is no transfer current value that is appropriate for both the single-layered portion and the triple-layered portion.

Figure 7:
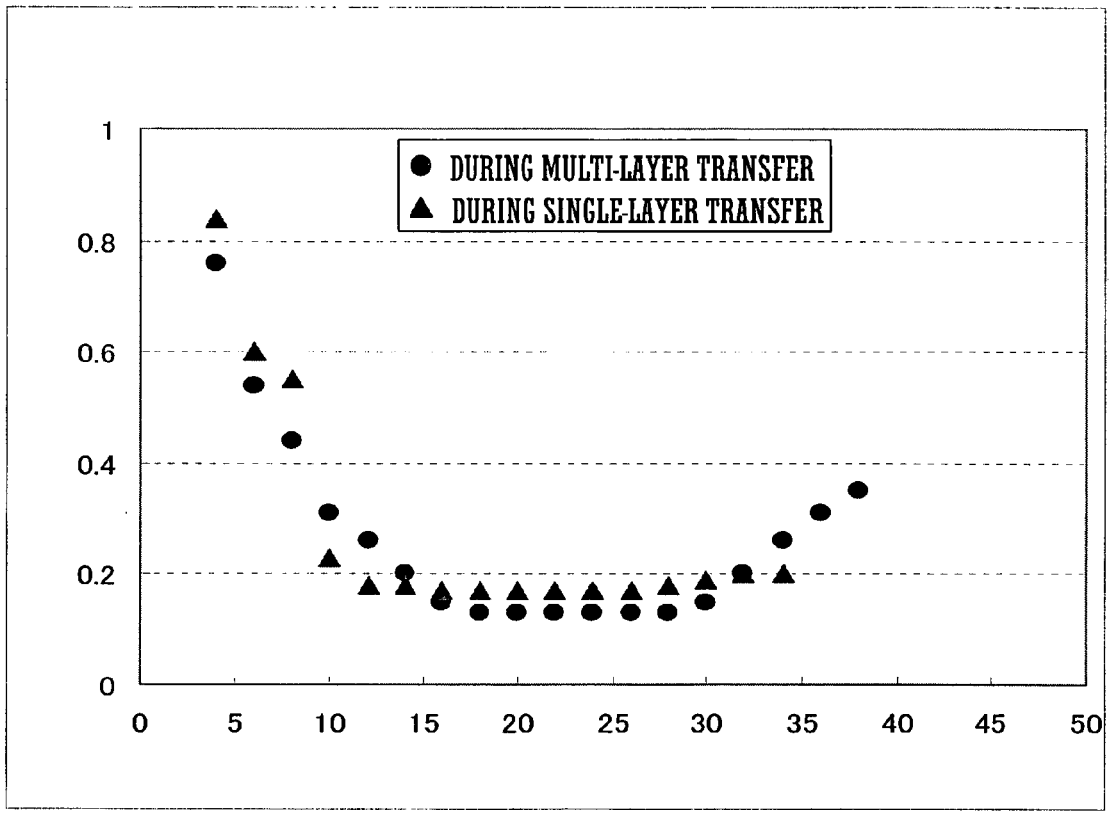
FIG. 7 is a diagram showing the relationship between the second transfer current value and the remaining toner density.

FIG. 7 shows the relationship between the second transfer current and the remaining toner density relating to the single-layered portion and the triple-layered portion when the charger 30 is used. FIG. 7 shows an example in which the optimal transfer current is 16 μA to 28 μA for both of the single-layered portion having a charge amount of −0.008 μC/cm$^2$ and the triple-layered portion having a charge amount of −0.024 μC/cm$^2$. In the example shown in FIG. 7, the difference between the charge amounts of the single-layered portion and the triple-layered portion is 0.016 μC/cm$^2$, and the range of the transfer current value appropriate for both the single-layered portion and the triple-layered portion is wider than the case in FIGS. 5 and 6.

From the results shown in FIGS. 5 to 7, it is clear that setting the second transfer current for the second transfer roller 14 becomes easier as the range of non-uniformity in the charge amount of toner on the intermediate transfer belt 11 per unit area becomes smaller. Furthermore, an investigation of the relationship between the charge amount difference and the easiness of setting the second transfer current obtained the results shown in FIG. 8.

The applicant has investigated the size of the second transfer current range that allows transfer to be satisfactorily performed, within the range in which non-uniformity in the charge amount of toner on the intermediate transfer belt 11 per unit area is equal to or less than 0.030 μC/cm$^2$. As a result, it was discovered that when the range of non-uniformity in the charge amount of toner on the intermediate transfer belt 11 per unit area is smaller than 0.025 μC/cm$^2$, the second transfer current range that allows transfer to be satisfactorily performed is widened to the extent that the second transfer can be satisfactorily performed.

In this embodiment, toner is charged using the charger 30 with the same polarity as the toner before the second transfer is performed with the second transfer roller 14. For example, when the apparent charge potential of the single-layered portion is −50V and the apparent charge potential of the multi-layered portion is −150 V, the charger 30 maybe activated so that all toner particles of the full-color toner image on the intermediate transfer belt 11 are charged to the potential of the multi-layered toner image.

In this embodiment, the CPU 50 activates the charger 30 when the CPU 50 determines, based on the results of detecting toner image thickness with the sensor group 40, that the range of non-uniformity in the charge amount of the full-color toner image on the intermediate transfer belt 11 per unit area is 0.025 μC/cm$^2$ or more. In addition, the CPU 50 activates the charger 30 when using toner in which the charge amount difference between the toner charge amounts formed on the photoreceptor drums 101A to 101D is 0.003 μC/cm$^2$ or more.

According to the aforementioned embodiment, the range of the electric field strength appropriate for all of the single-layered portion, the double-layered portion, and the triple-layered portion during the second transfer widens, and thus defects during the second transfer occur less even when the types of paper or the use environment varies to some extent. As a result, the color balance of a full-color toner image is not likely to be disturbed even when the color image is formed at a high speed with the tandem image forming apparatus 100.

Furthermore, in the aforementioned embodiment, the charger 30 is used for setting the range of non-uniformity in the charge amount of the full-color toner image per unit area to be smaller than 0.025 μC/cm$^2$, but the following methods also can be used for setting the range of non-uniformity in the charge amount of the full-color toner image per unit area to be smaller than 0.025 μC/cm$^2$, without the use of the charger 30.

As another method for setting the range of non-uniformity in the charge amount of the full-color toner image per unit area to be smaller than 0.025 μC/cm$^2$, a method is conceivable in which the development conditions are adjusted. For example, the development conditions are set such that the amount of toner supplied to the photoreceptor drums 101A to 101D is smaller than 0.4 mg/cm$^2$ and the charge amount of the toner particles at that time is smaller than −20 μC/g, so that the absolute value of the charge amount of the toner particles on the photoreceptor drums 101A to 101D per unit area becomes smaller than 0.008 μC/cm$^2$. It is experimentally known that when the absolute value of the charge amount of the toner particles on the photoreceptor drums 101A to 101D per unit area is smaller than 0.008 μC/cm$^2$, the range of non-uniformity in the charge amount of the full-color toner image per unit area is smaller than 0.025 μC/cm$^2$ Examples of development condition adjustment include adjustment of the development bias, adjustment of the toner stirring speed, and adjustment of the contact pressure between the development roller and the blade.

Furthermore, when the first transfer pressure, that is, the contact pressure between the photoreceptor drums 101A to 101D and the transfer rollers 13A to 13D, is set to be in a range of 1 g/mm$^2$ to 5 g/mm$^2$ in the image forming apparatus 100, toner particles can be prevented from scattering before the second transfer. In the image forming apparatus 100, the region in which the photoreceptor drums 101A to 101D and the intermediate transfer belt 11 are in contact with each other is widened by horizontally shifting the axes of the transfer rollers 13A to 13D with respect to the axes of the photoreceptor drums 101A to 101D, in order to reduce the contact pressure between the photoreceptor drums 101A to 101D and the intermediate transfer belt 11.

It should be noted that when the contact pressure between the photoreceptor drums 101A to 101D and the transfer rollers 13A to 13D is less than an appropriate pressure, transferred toner particles are dispersedly layered on the intermediate transfer belt 11. Thus, when toner particles with another color are transferred to the intermediate transfer belt 11, the toner image that has already been formed on the intermediate transfer belt 11 may be disturbed. On the other hand, when the contact pressure between the photoreceptor drums 101A to 101D and the transfer rollers 13A to 13D is larger than an appropriate pressure, layered toner particles are firmly fixed, and thus the toner particles tend to remain on the intermediate transfer belt 11 during the second transfer.

It is also possible to use a non-contact roller instead of the charger 30 in the aforementioned embodiment. However, it is important to bring the non-contact roller sufficiently close to the intermediate transfer belt 11 and to mirror finish the circumferential face of the non-contact roller, so as to narrow the range of non-uniformity in the charge amount of the full-color toner image per unit area with the non-contact roller.

Finally, the embodiments described above are to be considered in all respects as illustrative and not limiting. The scope of the invention is indicated by the appended claims rather than by the foregoing embodiments. Furthermore, all changes which come within the meaning and range of equivalency of the claims are intended to be embraced in the scope of the invention.

What is claimed is:

1. An image forming apparatus using a tandem method for a first transfer procedure, the image forming apparatus comprising:

a plurality of image bearing members for carrying images of respective colors;

an intermediate transfer member rotatably disposed so as to face the image bearing members;

a plurality of first transfer devices for forming a full-color toner image on the intermediate transfer member by transferring color toner images formed on the image bearing members to the intermediate transfer member;

a second transfer device for transferring the full-color toner image formed on the intermediate transfer member to a recording sheet; and a charge amount adjustment section for adjusting a charge amount of toner particles constituting the full-color toner image so as to reduce non-uniformity in a charge amount of toner particles of the full-color toner image on the intermediate transfer member per unit area, wherein the charge amount adjustment section suppresses a range of the non-uniformity in the charge amount of the toner particles of the full-color toner image on the intermediate transfer member per unit area to be less than 0.025 $\mu C/cm^2$, further comprising:

sensors for detecting thickness of a full-color toner image on the intermediate transfer member, and a controller adapted to activate the charge amount adjustment section when determining, based on the detection results of the sensors, that the range of non-uniformity in the charge amount of the full-color toner image on the intermediate transfer belt per unit area is 0.025 $\mu C/cm^2$ or more, wherein development conditions are set such that the amount of the toner particles supplied to the image bearing members is smaller than 0.4 $mg/cm^2$ and the charge amount of the toner particles at such time is smaller than −20 $\mu C/g$.

2. The image forming apparatus according to claim 1, wherein the controller activates the charge amount adjustment section when using toner particles in which the charge amount difference between the toner particles formed on the image bearing members is 0.003 $\mu C/cm^2$ or more.

* * * * *